US010471319B1

(12) United States Patent
Mata

(10) Patent No.: US 10,471,319 B1
(45) Date of Patent: Nov. 12, 2019

(54) IRON GOLF CLUB HEAD WITH BADGE

(71) Applicant: Acushnet Company, Fairhaven, MA (US)

(72) Inventor: Jason A. Mata, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/214,405

(22) Filed: Dec. 10, 2018

(51) Int. Cl.
*A63B 53/04* (2015.01)
*A63B 60/54* (2015.01)
*A63B 102/32* (2015.01)

(52) U.S. Cl.
CPC ..... *A63B 60/54* (2015.10); *A63B 53/047* (2013.01); *A63B 2053/0416* (2013.01); *A63B 2102/32* (2015.10); *A63B 2209/00* (2013.01)

(58) Field of Classification Search
USPC ..... 473/324–350
See application file for complete search history.

(56) References Cited

U.S. PATENT DOCUMENTS 2,077,377 A 4/1937 Link
4,811,950 A * 3/1989 Kobayashi ..... A63B 53/04 473/335
4,826,172 A 5/1989 Antonious
4,928,972 A * 5/1990 Nakanishi ..... A63B 53/04 473/332
5,136,298 A 8/1992 Williams
5,316,298 A * 5/1994 Hutin ..... A63B 53/04 473/332
5,586,947 A * 12/1996 Hutin ..... A63B 53/04 473/324
5,588,923 A * 12/1996 Schmidt ..... A63B 53/04 473/340
5,626,530 A * 5/1997 Schmidt ..... A63B 53/04 473/324
5,766,092 A 6/1998 Mimeur et al.
6,042,486 A 3/2000 Gallagher
6,719,641 B2 * 4/2004 Dabbs ..... A63B 53/04 473/291
6,835,144 B2 * 12/2004 Best ..... A63B 53/047 473/332
6,887,164 B2 5/2005 Danwanjee
7,008,331 B2 3/2006 Chen
(Continued)

FOREIGN PATENT DOCUMENTS

JP 03007178 A * 1/1991 ..... A63B 53/0466
JP 2003284794 A * 10/2003
JP 2009240365 A * 10/2009 ..... A63B 53/047

*Primary Examiner* — Alvin A Hunter
(74) *Attorney, Agent, or Firm* — Kevin N. McCoy

(57) ABSTRACT

A golf club head, including a body including a striking face and a perimeter portion extending aft from the striking face, a badge affixed to a rear surface of the striking face, wherein the badge comprises a first layer aft of the striking face, the first layer including a first density, a second layer aft of the first layer, the second layer including a second density, and a third layer aft of the first layer, wherein the third layer comprises a third layer front surface located adjacent the second layer, the third layer font surface including a third layer cavity, wherein the second layer resides within the third layer cavity, wherein the first density is less than 2.0 g/cm$^3$, wherein the second density is greater than 2.0 g/cm$^3$.

20 Claims, 7 Drawing Sheets

(56) References Cited

U.S. PATENT DOCUMENTS

| | | | | |
|---|---|---|---|---|
| 7,371,190 | B2 | 5/2008 | Gilbert | |
| 7,387,579 | B2 * | 6/2008 | Lin | A63B 53/04 473/332 |
| 7,731,604 | B2 * | 6/2010 | Wahl | A63B 53/047 473/337 |
| 7,878,920 | B2 | 2/2011 | Clausen | |
| 7,892,106 | B2 * | 2/2011 | Matsunaga | A63B 53/047 473/290 |
| 8,088,025 | B2 | 1/2012 | Wahl | |
| 8,157,673 | B2 | 4/2012 | Gilbert | |
| 8,267,807 | B2 | 9/2012 | Takechi | |
| 8,328,663 | B2 | 12/2012 | Wahl | |
| 8,333,667 | B2 * | 12/2012 | Kumamoto | A63B 53/04 473/342 |
| 8,517,863 | B2 | 8/2013 | Wahl | |
| 8,753,219 | B2 | 6/2014 | Gilbert | |
| 8,864,603 | B2 * | 10/2014 | Kumamoto | A63B 53/047 473/332 |
| 8,920,261 | B2 * | 12/2014 | Taylor | B23P 11/02 473/350 |
| 8,961,336 | B1 | 2/2015 | Parsons et al. | |
| 9,039,543 | B2 * | 5/2015 | Mizutani | A63B 53/047 473/332 |
| 9,265,995 | B2 | 2/2016 | Wahl | |
| 9,597,562 | B2 | 3/2017 | Dipert | |
| 9,662,549 | B2 * | 5/2017 | Vrska, Jr. | A63B 53/0475 |
| 10,039,965 | B1 * | 8/2018 | Seluga | A63B 53/0475 |
| 2009/0247314 | A1 * | 10/2009 | Matsunaga | A63B 53/047 473/291 |
| 2010/0056296 | A1 * | 3/2010 | Kumamoto | A63B 53/047 473/332 |
| 2012/0172144 | A1 * | 7/2012 | Mazutani | A63B 53/047 473/332 |

* cited by examiner

IRON GOLF CLUB HEAD WITH BADGE

TECHNICAL FIELD

This present technology generally relates to systems, devices, and methods related to golf clubs, and more specifically to iron type golf clubs with a badge. More specifically, the present invention discloses an iron type golf club head with a badge located near a rear portion of the iron type golf club head. This badge not only provides an improvement in the overall aesthetics of the golf club head, it also improves the damping properties of the iron type golf club head.

DESCRIPTION OF THE RELATED TECHNOLOGY

The game of golf often involves the usage of a vast variety of different equipment. Generally speaking, a golfer may have several different types of clubs differing in three major categories; woods, irons, and a putter. Although different golfers may differ on what their favorite type of golf club in the bag may be, most all of them will say that their iron type golf clubs play a crucial part in their golf game.

Within the iron type category, the types of golf clubs are generally separated into two major categories, a muscle back type iron and a cavity back type iron. A muscle back type iron may generally be defined as a golf club formed from a unitary piece of metal that has a portion of increased thickness called a "muscle portion". Muscle back type irons have been existence since the early days of golf, and U.S. Pat. No. 2,007,377 to Link is an illustration of an early design of a muscle back iron. A cavity back iron, on the other hand, may generally refer to a golf club that creates an opening near the back portion of the golf club head. Although cavity type irons may generally have an open cavity that is exposed like shown in U.S. Pat. No. 4,826,172 to Antonious, the cavity back iron may also include a closed opening construction that creates an enclosed volume as shown in U.S. Pat. No. 5,766,092 to Mimeur et al.

The invention of cavity back irons provides significant performance advantages compared to the traditional muscle back irons. First and foremost, by removing weight from the back portion of the golf club, cavity back irons may generally be able to increase the moment of inertia of the golf club head by placing weight near the perimeter extremities of the golf club head. In addition to increasing the moment of inertia, cavity back irons can further improve the performance of the iron type golf club head by increasing the distance of the iron type golf club head. In general, golf clubs can achieve more distance by increasing the coefficient of restitution of the striking face, which cavity back irons can achieve by thinning out the striking face.

Due to the fact that cavity back irons require an opening in the rear portion of the golf club head that can be cosmetically unappealing, golf club designers have attempted to remedy that deficiency by adding a badge to fill the cavity of the opening. U.S. Pat. No. 8,920,261 to Taylor et al. provides one illustration of an attempt at a badge that helps achieve that goal.

Focusing our discussion further on the cavity back irons, as discussed above that in order to improve the performance of these types of irons, golf club designers often try to create an extremely thin face to allow for more deflection of the face during impact with a golf ball. The increased deflection of the face during impact with a golf ball will generally allow the golf ball to travel further than a thicker face counterpart, thereby increasing the performance of the cavity back iron type golf club. U.S. Pat. No. 7,008,331 to Chen illustrates one of the earlier examples of experimenting with a thin face iron to increase the performance of an iron type golf club head.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that thinner and more flexible golf club head faces tend to create a louder sound when they strike a golf ball, which may not be the preference of some golfers. Thus, there exists a need for an improved badge which helps attenuate some of that sound.

One non-limiting embodiment of the present technology includes a golf club head, including a body including a striking face and a perimeter portion extending aft from the striking face; wherein the perimeter portion comprises a sole located below the striking face; wherein the perimeter portion comprises a topline located above the striking face; wherein the body comprises a body cavity formed behind the striking face and within the perimeter portion; wherein the striking face comprises a front surface, configured to strike a golf ball, and a rear surface opposite the front surface; a badge affixed to the rear surface of the striking face; wherein the badge comprises: a first layer aft of the striking face, the first layer including a first density and a first young's modulus; a second layer aft of the first layer, the second layer including a second density and a second young's modulus; and a third layer aft of the first layer; wherein the third layer comprises a third layer front surface located adjacent the second layer, the third layer font surface including a third layer cavity, wherein the second layer resides within the third layer cavity; wherein the first density is less than 2.0 g/cm3 and the first young's modulus is less than 40 Gpa; wherein the second density is greater than 2.0 g/cm3 and the second young's modulus is greater than 40 Gpa.

An additional non-limiting embodiment of the present technology includes a golf club head, including a body including a striking face and a perimeter portion extending aft from the striking face; wherein the perimeter portion comprises a sole located below the striking face; wherein the perimeter portion comprises a topline located above the striking face; wherein the body comprises a body cavity formed behind the striking face and within the perimeter portion; wherein the striking face comprises a front surface, configured to strike a golf ball, and a rear surface opposite the front surface; a badge affixed to the rear surface of the striking face; wherein the badge comprises a first layer aft of the striking face, the first layer including a first density; a second layer aft of the first layer, the second layer including a second density; and a third layer aft of the first layer; wherein the third layer comprises a third layer front surface located adjacent the second layer, the third layer font surface including a third layer cavity, wherein the second layer resides within the third layer cavity; wherein the first density is less than 2.0 g/cm3; wherein the second density is greater than 2.0 g/cm3.

In an additional non-limiting embodiment of the present technology the golf club head of claim 2, wherein the first layer comprises a first young's modulus and the second layer comprises a second young's modulus, wherein the first young's modulus is less than 40 Gpa and wherein the second young's modulus is greater than 40 Gpa.

In an additional non-limiting embodiment of the present technology the golf club head of claim 2, wherein the second layer comprises a second layer front surface, located adjacent the first layer, a second layer rear surface, located opposite the second layer front surface, a second layer top side surface located towards the topline, and a second layer sole side surface located towards the sole, the second layer sole side surface located opposite the second layer top side surface, wherein the second layer front surface abuts the first layer, wherein the second layer rear surface abuts the third layer, wherein the second layer top side surface abuts the third layer, and wherein the second layer bottom side surface abuts the third layer.

In an additional non-limiting embodiment of the present technology the first layer is viscoelas tic.

In an additional non-limiting embodiment of the present technology the second layer is aluminum.

In an additional non-limiting embodiment of the present technology the badge further comprises a fourth layer located aft of the third layer.

In an additional non-limiting embodiment of the present technology the second layer comprises a plurality of apertures formed through the second layer.

In an additional non-limiting embodiment of the present technology the striking face comprises a maximum striking face width, wherein the first layer comprises a maximum first layer width, wherein the second layer comprises a maximum second layer width, wherein the maximum striking face width is greater than the maximum first layer width, and wherein the maximum first layer width is greater than the maximum second layer width.

In an additional non-limiting embodiment of the present technology the third layer comprises a third layer maximum width, wherein the third layer maximum width is greater than the first layer maximum width.

An additional non-limiting embodiment of the present technology includes a golf club head, including a body including a striking face and a perimeter portion extending aft from the striking face; wherein the perimeter portion comprises a sole located below the striking face; wherein the perimeter portion comprises a topline located above the striking face; wherein the body comprises a body cavity formed behind the striking face and within the perimeter portion; wherein the striking face comprises a front surface, configured to strike a golf ball, and a rear surface opposite the front surface; a badge affixed to the rear surface of the striking face; wherein the badge comprises: a first layer aft of the striking face, the first layer including a first young's modulus; a second layer aft of the first layer, the second layer including a second young's modulus; and a third layer aft of the first layer; wherein the second layer comprises a second layer front surface, located adjacent the first layer, a second layer rear surface, located opposite the second layer front surface, a second layer top side surface located towards the topline, and a second layer sole side surface located towards the sole, the second layer sole side surface located opposite the second layer top side surface; wherein the second layer front surface abuts the first layer, wherein the second layer rear surface abuts the third layer, wherein the second layer top side surface abuts the third layer, and wherein the second layer bottom side surface abuts the third layer; wherein the first young's modulus is less than 40 Gpa; wherein the second young's modulus is greater than 40 Gpa.

In an additional non-limiting embodiment of the present technology the first layer comprises a first density and the second layer comprises a second density, wherein the first density is less than 2.0 g/cm3 and wherein the second density is greater than 2.0 g/cm3.

In an additional non-limiting embodiment of the present technology the third layer comprises a third layer front surface located adjacent the second layer, the third layer font surface including a third layer cavity, wherein the second layer resides within the third layer cavity.

In an additional non-limiting embodiment of the present technology the first layer is viscoelastic.

In an additional non-limiting embodiment of the present technology the second layer is aluminum.

In an additional non-limiting embodiment of the present technology the badge further comprises a fourth layer located aft of the third layer.

In an additional non-limiting embodiment of the present technology the second layer comprises a plurality of apertures formed through the second layer.

In an additional non-limiting embodiment of the present technology the striking face comprises a maximum striking face width, wherein the first layer comprises a maximum first layer width, wherein the second layer comprises a maximum second layer width, wherein the maximum striking face width is greater than the maximum first layer width, and wherein the maximum first layer width is greater than the maximum second layer width.

In an additional non-limiting embodiment of the present technology the third layer comprises a third layer maximum width, wherein the third layer maximum width is greater than the first layer maximum width.

In an additional non-limiting embodiment of the present technology the second layer has a height greater than or equal to 10 mm and a length greater than or equal to 20 mm.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
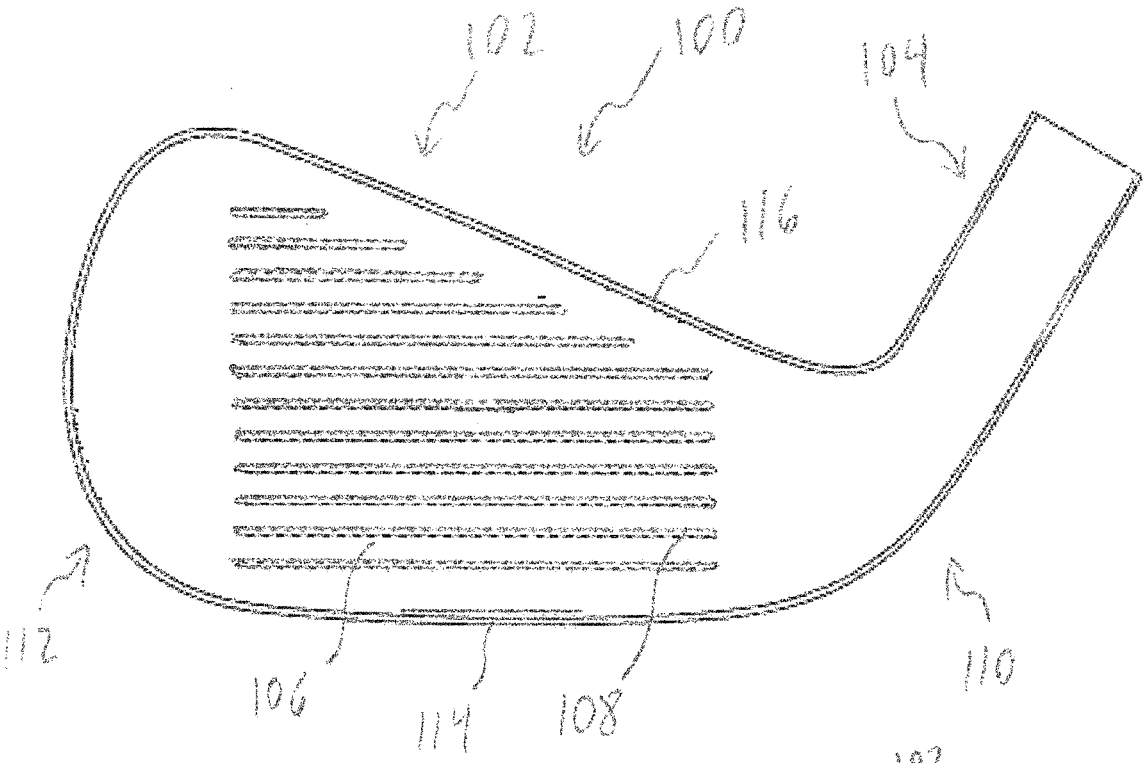
FIG. 1 depicts a front view of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Figure 2:
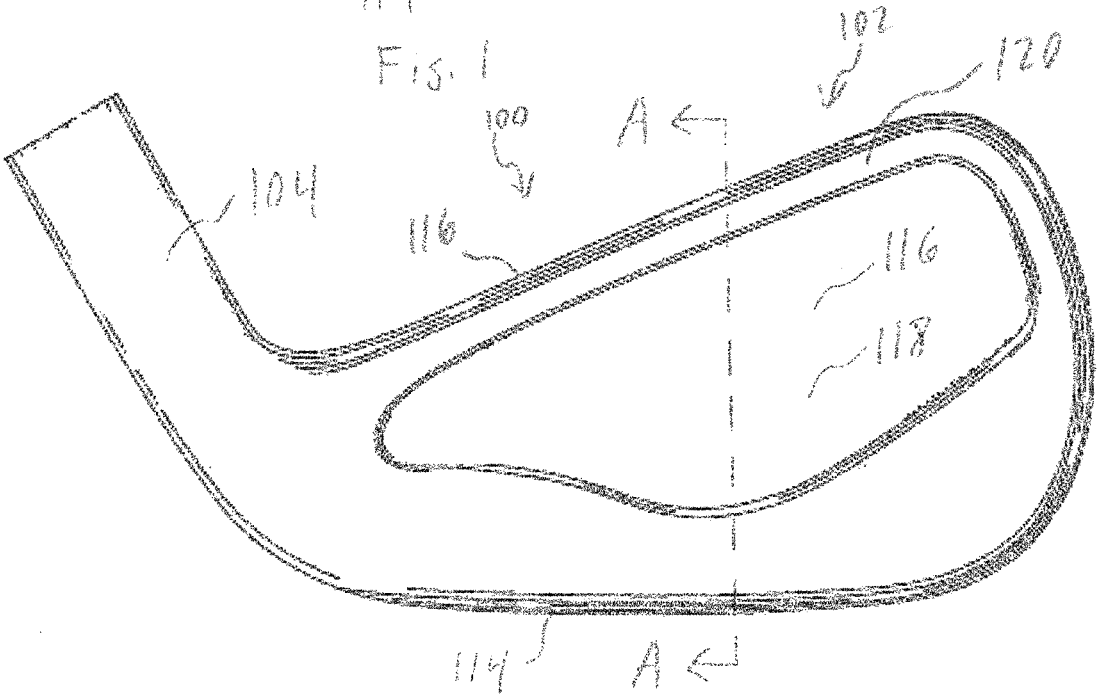
FIG. 2 depicts a rear view of the golf club head of FIG. 1.
Figure 3:
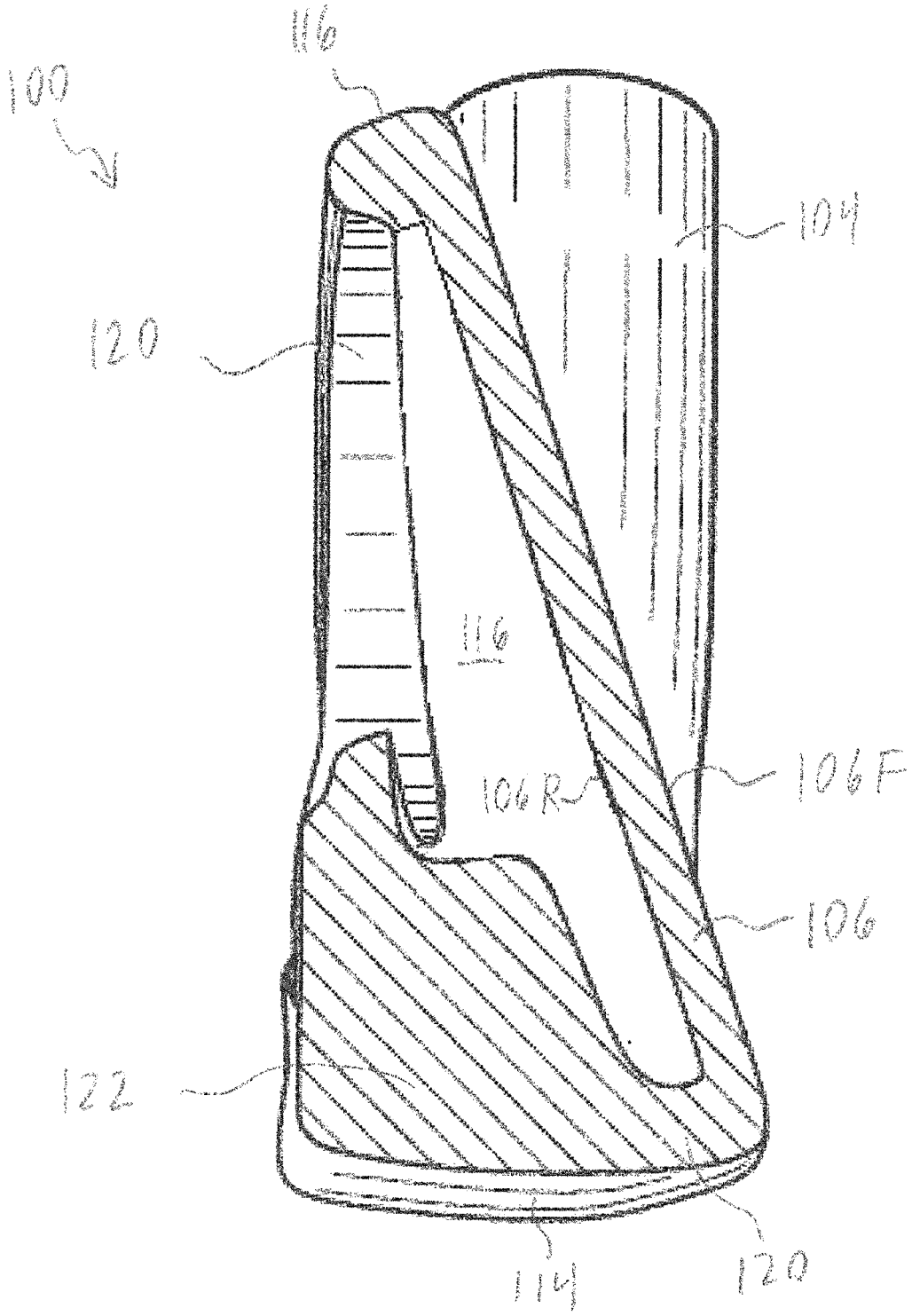
FIG. 3 depicts a cross-sectional view A-A of the golf club head of FIG. 1.
Figure 6:
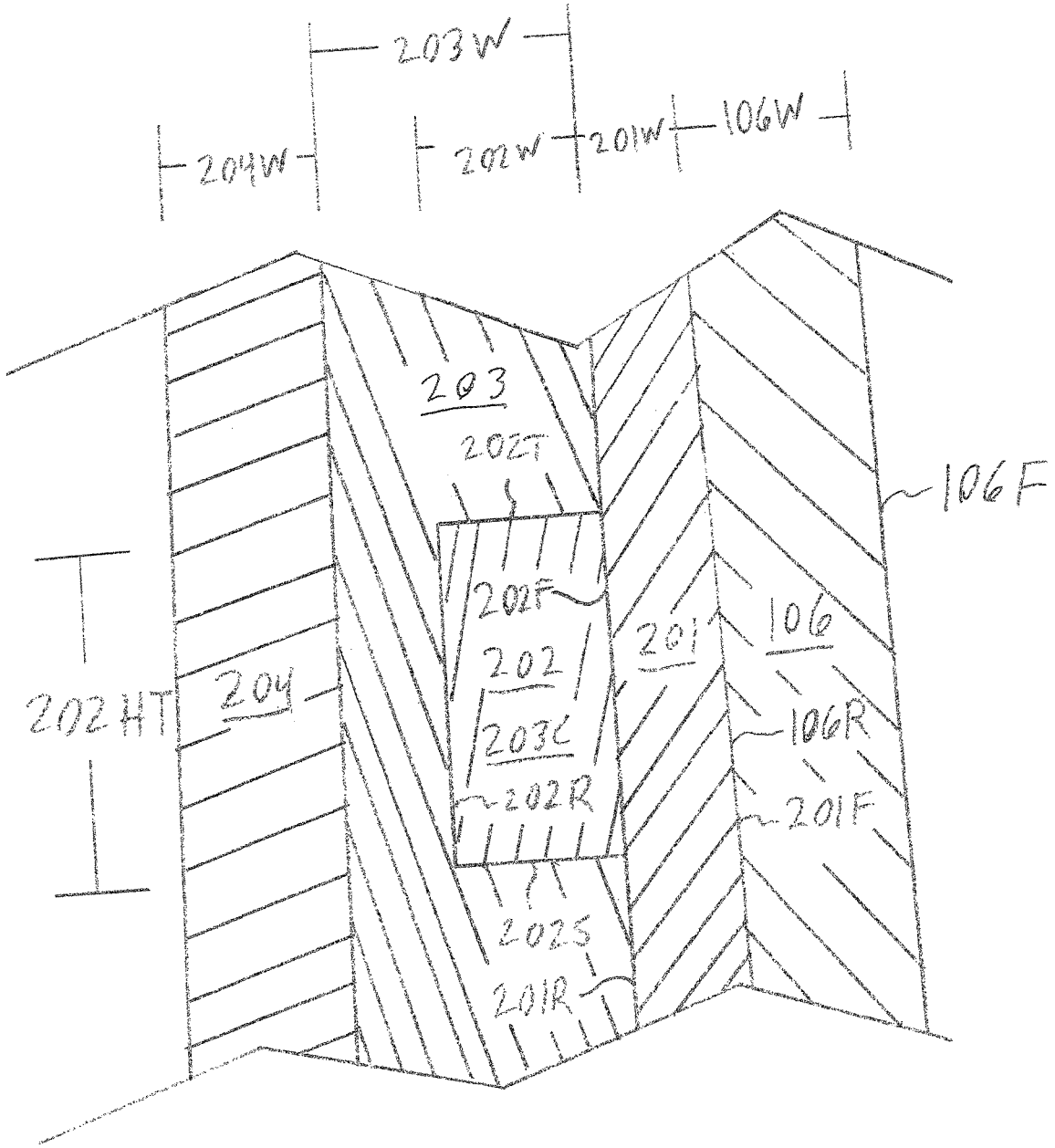
FIG. 6 depicts a detail view of the cross-sectional view A-A of FIG. 5.
Figure 7:
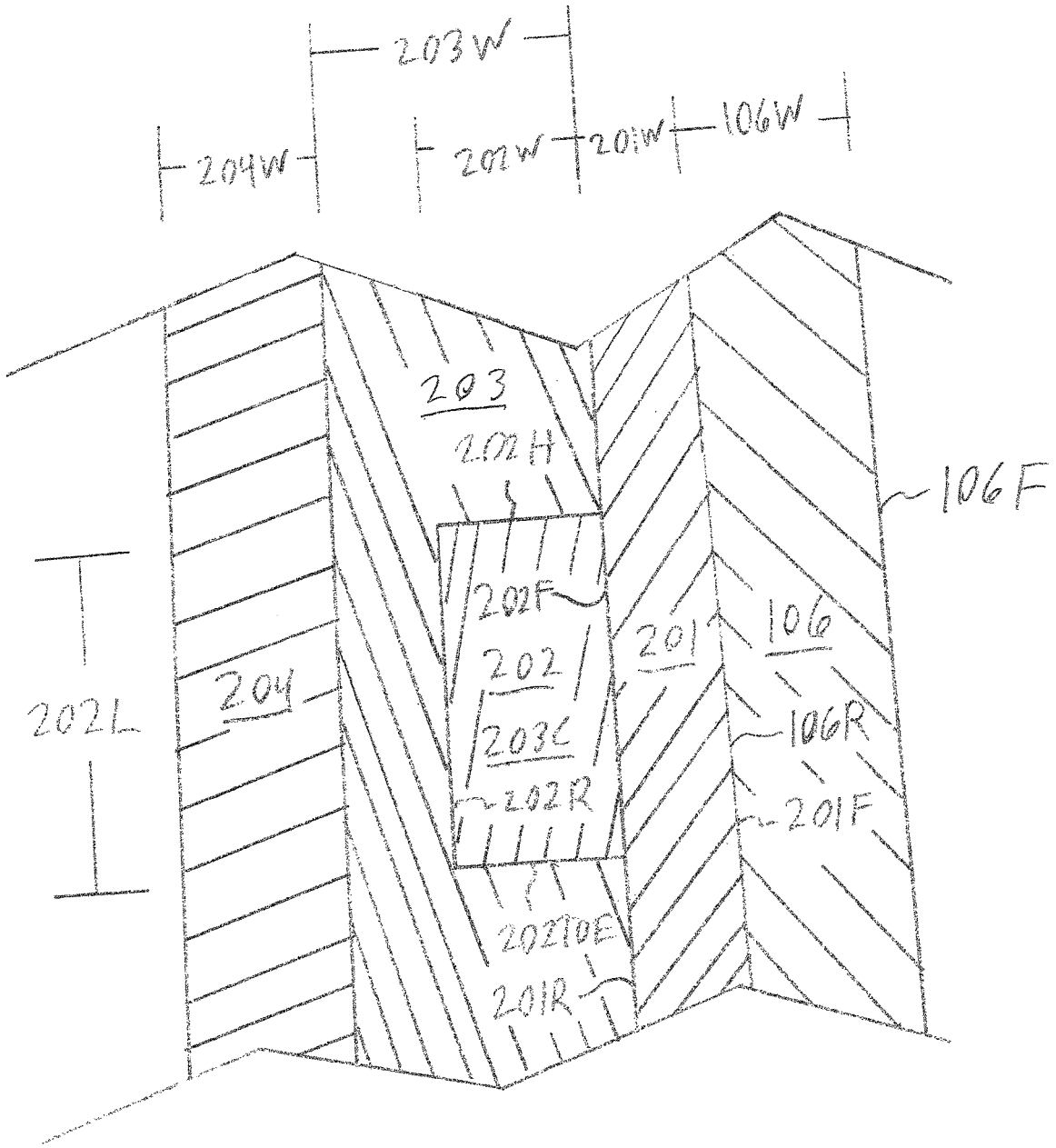
FIG. 7 depicts a detail cross-sectional view B-B of the golf club head of FIG. 4.
Figure 8:
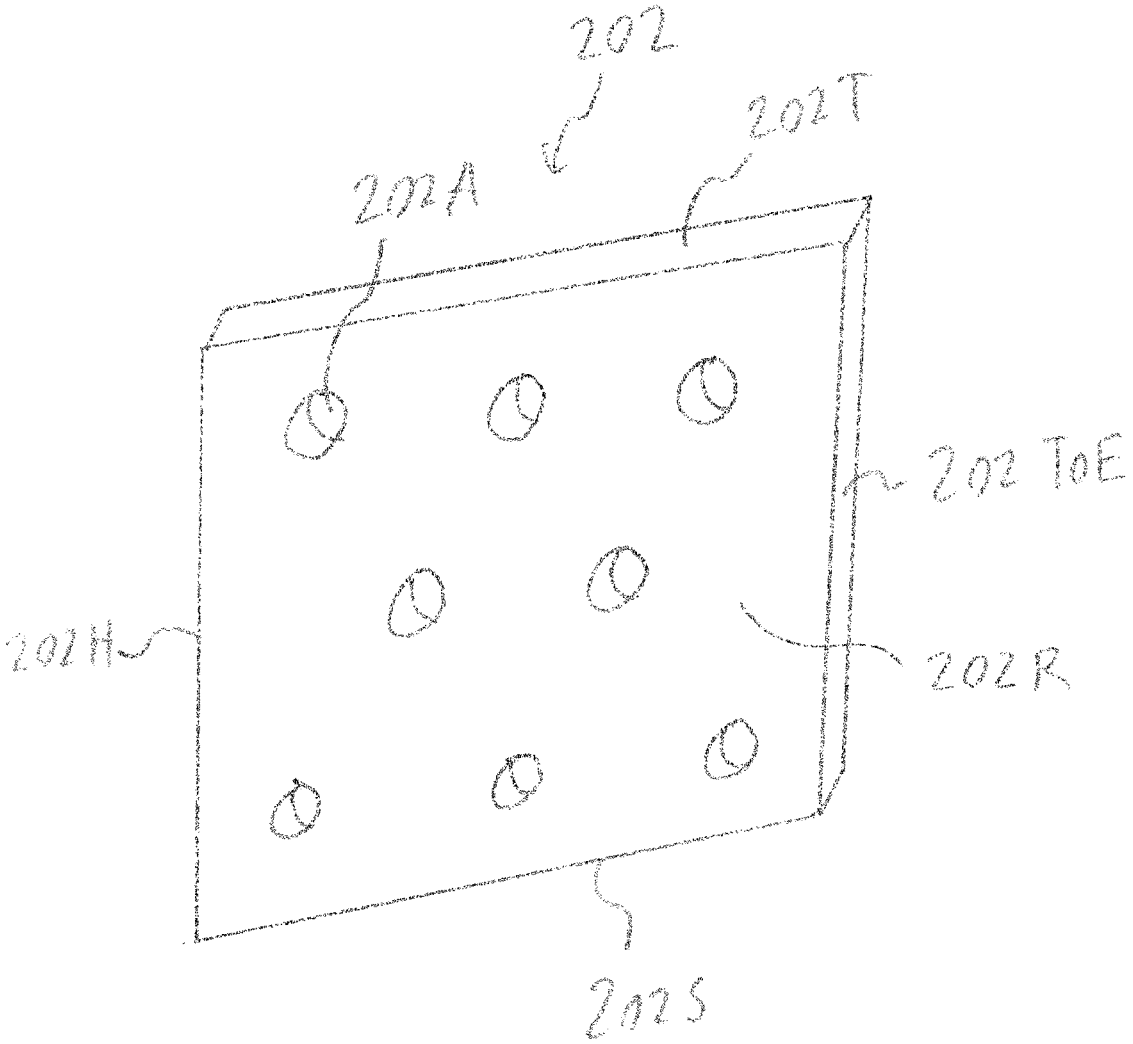
FIG. 8 depicts a perspective view of the second layer 202 of the badge 200.

FIGS. 1-3 illustrate an iron type cavity back golf club head 100 without a badge. FIGS. 4-7 illustrate the golf club head 100 of FIGS. 1-3 including a badge 200. FIG. 8 depicts a perspective view of the second layer 202 of the badge 200. The badge 200 can increase the aesthetic appeal of the golf club head 100. Additionally, the badge 200 described herein can dampen the vibrations of the striking face 106, changing the acoustic signature of the golf club head 100 so that it is more appealing to a golfer.

Figure 4:
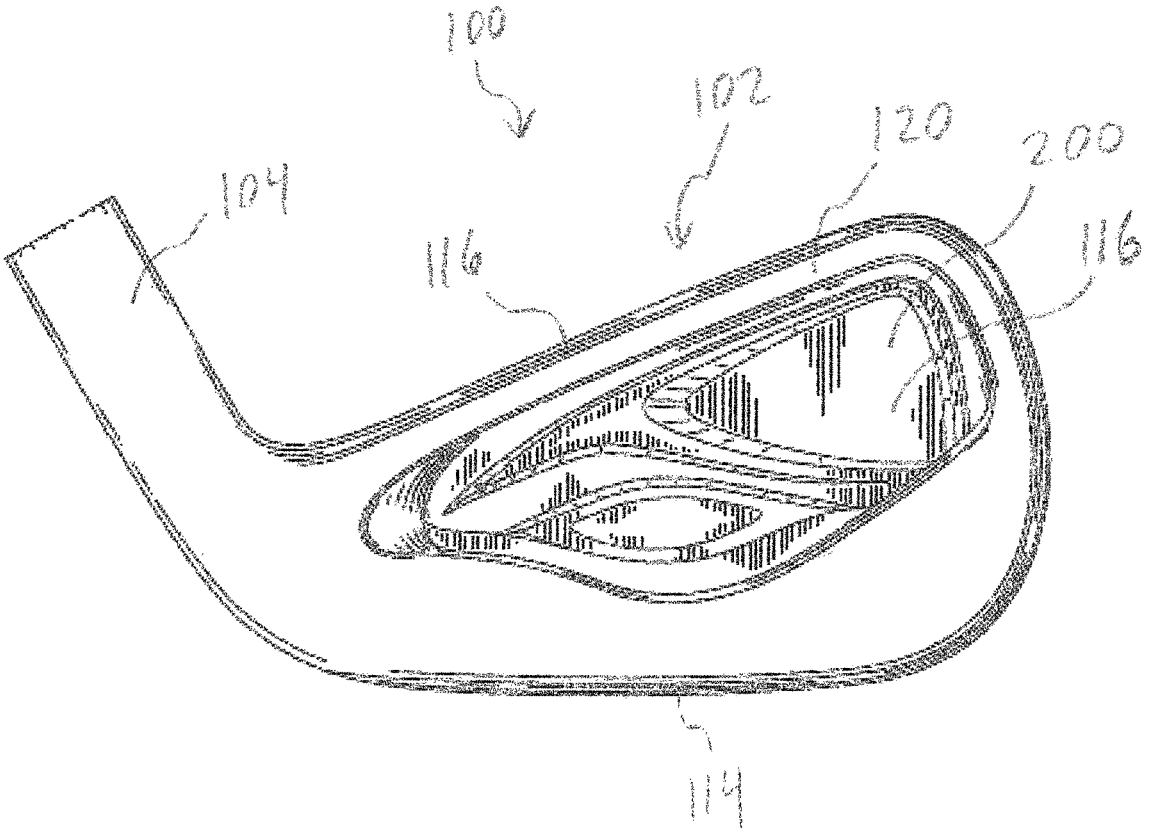
FIG. 4 depicts a rear view of the golf club head of FIG. 1 including a badge.
Figure 5:
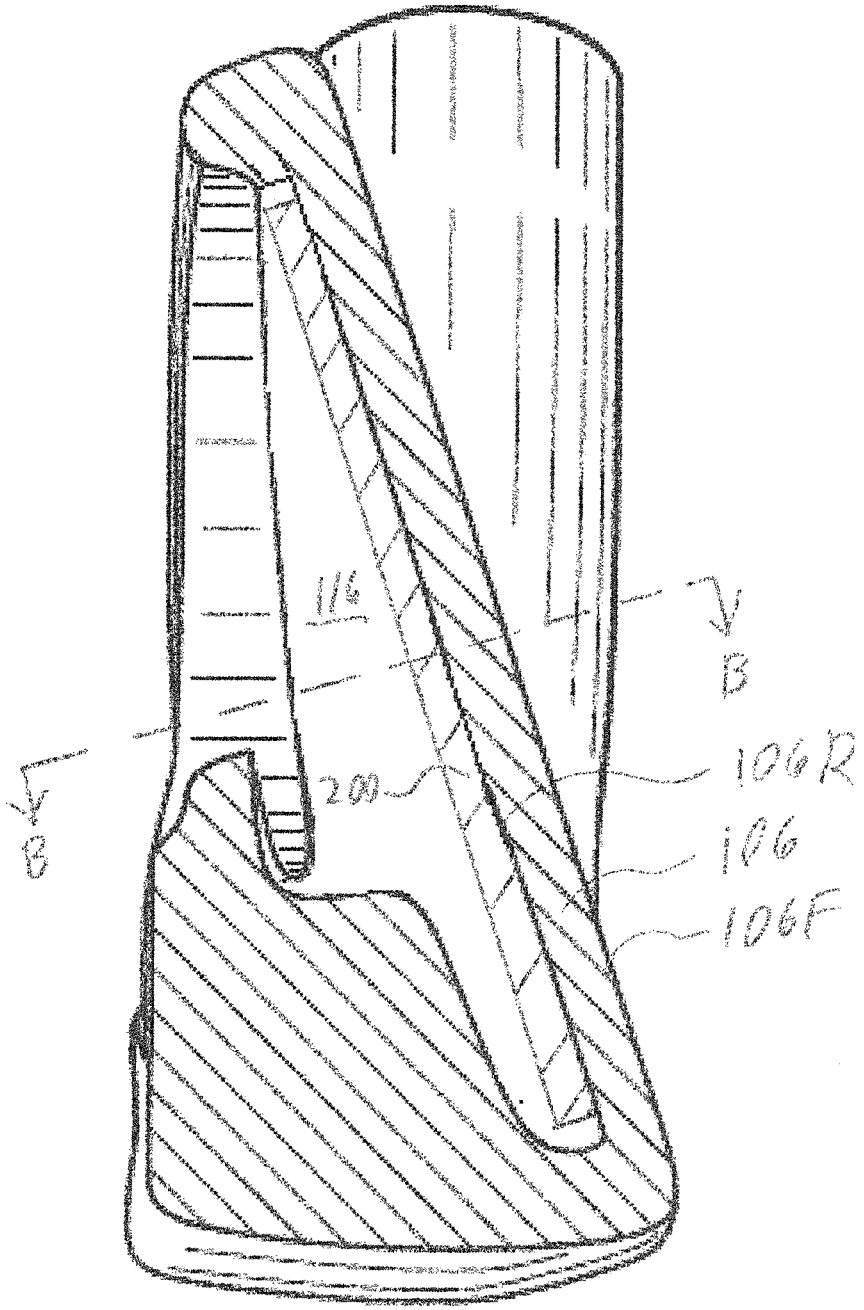
FIG. 5 depicts cross-sectional view A-A of the golf club head of FIG. 1 including a badge.

FIG. 1 depicts a front view of a golf club head 100. FIG. 2 depicts a rear view of the golf club head 100 of FIG. 1. FIG. 3 depicts a cross-sectional view A-A of the golf club head 100 of FIG. 1. FIG. 4 depicts a rear view of the golf club head 100 of FIG. 1 including a badge. FIG. 5 depicts cross-sectional view A-A of the golf club head 100 of FIG. 1 including a badge. FIG. 6 depicts a detail view of the cross-sectional view A-A of FIG. 5. FIG. 7 depicts a detail cross-sectional view B-B of the golf club head 100 of FIG. 4. FIG. 8 depicts a perspective view of the second layer 202 of the badge 200. The golf club head 100 is illustrated in an address position at prescribed loft and lie. Any references to locations of portions of the golf club head 100 are made with the golf club head 100 in an address position.

As illustrated in FIGS. 1-3, the golf club head 100 is an iron type golf club head, and more specifically, a cavity back iron type golf club head. The golf club head 100 includes a hosel 104 affixed to a body 102. The body 102 includes heel side 110 adjacent the hosel 104 and a toe side 112 opposite the heel side 110. The body 102 includes a striking face 106 configured to strike a golf ball. The striking face 106 includes a plurality of scorelines 108 formed in the striking face 106. The body 102 includes a perimeter portion 120 extending back from the edges of the striking face 106 which includes a topline 116 located above the striking face 106 and a sole 114 located below the striking face 106. A cavity 116 is formed behind the striking face and within the perimeter portion 120. The golf club head 100 can also include a weight pad 122. The striking face 106 includes a front surface 106F configured to strike a golf ball and a rear surface 106R opposite the front surface adjacent the cavity 116.

As illustrated in FIGS. 4-7, the golf club head 100 includes a badge 200 affixed to a rear surface 106R of the striking face 106. The badge 200 is located within the cavity 116 of the golf club head 100. As illustrated in FIGS. 6 and 7, the badge 200 includes a plurality of layers. Please note FIG. 5 does not illustrate each individual layer of the badge 200 as they would be too difficult to decipher outside of a detail view. The badge can include a first layer 201 which includes a front surface 201F which abuts the rear surface 106R of the striking face 106. The first layer 201 also includes a rear surface 201R opposite the front surface 201F.

As illustrated in FIG. 6, the badge can include a second layer 202 which is located aft of the first layer 201. The second layer 202 includes a front surface 202F which abuts the rear surface 201R of the first layer 201. The second layer 202 includes a rear surface 202R opposite the front surface 202F. The second layer 202 includes a top side surface 202T and a sole side surface 202S opposite the top side surface 202T, the top side surface 202T being located closer to the topline 116 and the sole side surface 202S being located closer to the sole 114. As illustrated in FIG. 7, the second layer 202 can include a heel side surface 202H and a toe side surface 202TOE, opposite the heel side surface 202H.

The badge can include a third layer 203 which is located aft of the first layer 201 and abuts the rear surface 202R of the second layer. The third layer 203, as illustrated in FIG. 6, can also abut the rear surface 201F of the first layer 201. Additionally, as illustrated in FIG. 6, the third layer 203 can abut the top side surface 202T and the sole side surface 202S of the second layer 202. As illustrated in FIG. 7, the third layer 203 can abut the heel side surface 202H and the toe side surface 202TOE. The third layer 203 can abut every surface of the second layer 202 with the exception of the front surface 202F. Additionally, as illustrated in FIGS. 6 and 7, the third layer front surface 203F can include a third layer cavity 203C, and the second layer 202 can reside within the third layer cavity 203C.

The badge can include a fourth layer located aft of the third layer 203. The fourth layer 204 can abut the third layer 203.

Each of the layers of the badge 200 can have a width. Each layer may have a constant width or the width can vary. The striking face 106 has a striking face maximum width 106W. The first layer 201 has a maximum width 201W. The second layer 202 has a maximum width 202W. The third layer 203 has a maximum width 203W. The fourth layer 204 has a maximum width 204W. The width of each layer can be consistent, or it can vary across its height or length. The maximum width is measured as the thickest single portion of each layer measured along a line perpendicular to the front surface 106F of the striking face 106.

In one embodiment, the striking face maximum width 106W is approximately 1.9 millimeters (mm), the first layer maximum width 201W is approximately 0.50 mm, the second layer maximum width 202W is approximately 0.60 mm, the third layer maximum width 203W is approximately 4 mm, the fourth layer maximum width 204W is approximately 0.15 mm.

In an additional embodiment, the striking face maximum width 106W is less than 2.0 millimeters (mm). The first layer maximum width 201W is greater than 0.25 mm. The second layer maximum width 202W is less than 1.0 mm. The third layer maximum width 203W is great than 1.0 mm. The fourth layer maximum width 204W is less than 0.5 mm. In an additional embodiment, the striking face maximum width 106W is less than 2.20 mm. In an additional embodiment, the striking face maximum width 106W is less than 2.40 mm. In an additional embodiment, the striking face maximum width 106W is less than 2.60 mm.

In addition, as illustrated in FIG. 6, the second layer 202 has a height 202HT measured from the top side surface 202T to the sole side surface 202S. As illustrated in FIG. 7, the second layer 202 has a length 202L measured from the heel side surface 202HT to the toe side surface 202TOE. The third layer 203, as illustrated in FIGS. 6 and 7, can include a cavity 203C configured to receive the second layer 202. In one embodiment, the height 202HT is approximately 18 mm. In one embodiment, the length 202L is approximately 60 mm. In an additional embodiment the height 202HT is greater than or equal to 10 mm. In an additional embodiment the length 202L is greater than or equal to 20 mm.

The striking face 106 can be formed from a plurality of materials, which may include, for example, steel, stainless steel, aluminum, titanium, composite, carbon fiber composite, plastic, fiber reinforced plastic, etc.

Each of the layers 201, 202, 203, 204 of the badge 200 can be formed from a plurality of materials, which may include, for example, double sided foam tape, foam, elastomer, rubber, steel, stainless steel, aluminum, titanium, composite, carbon fiber composite, plastic, fiber reinforced plastic, polymer, thermoplastic, acrylonitrile butadiene styrene, polyurethane, thermoplastic polyurethane, cyanoacrylate, etc.

Each layer can include an adhesive layer on either side to bond to the striking face or other layers. Some of the layers may include an adhesive on one or more sides or some layers may include adhesive impregnated in the layer. As illustrated in FIG. 8, the second layer 202 can have a plurality of apertures 202A formed therethrough to reduce the weight of the second layer 202. Other layers may incorporate similar features.

The first layer 201 can be formed of a viscoelastic material. When the viscoelastic first layer 201 is sandwiched between two stiffer materials, the striking face 106 and the second layer 202, the combination can offer effective damping properties, helping to reduce the acoustic output of the striking face 106 when striking a golf ball. The second layer 202 can effectively constrain the viscoelastic first layer 201, creating a constrained layer damping effect.

The order, width, and characteristics of each layer of the badge 200 is important to how it effects the acoustic signature of the golf club head. The first layer 201 of the badge 200 can have a first density and a first young's modulus. The second layer 202 can have a second density and a second young's modulus. In one embodiment, the first density is less than 2.0 grams/centimeter$^3$ (g/cm$^3$). In one embodiment, the first young's modulus is less than 40 GPa. In one embodiment, the second density is greater than 2.0 g/cm$^3$. In one embodiment, the second young's modulus is greater than 40 GPa. In one embodiment, the second density is approximately 2.7 g/cm$^3$ and the second young's modulus is approximately 69 Gigapascals (GPa).

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

I claim:

1. A golf club head, comprising:

a body comprising a striking face and a perimeter portion extending aft from said striking face;

wherein said perimeter portion comprises a sole located below said striking face;

wherein said perimeter portion comprises a topline located above said striking face;

wherein said body comprises a body cavity formed behind said striking face and within said perimeter portion;

wherein said striking face comprises a front surface, configured to strike a golf ball, and a rear surface opposite said front surface;

a badge affixed to said rear surface of said striking face;

wherein said badge comprises:

a first layer aft of said striking face, said first layer comprising a first density and a first young's modulus;

a second layer aft of said first layer, said second layer comprising a second density and a second young's modulus; and a third layer aft of said first layer;

wherein said third layer comprises a third layer front surface located adjacent said second layer, said third layer font surface comprising a third layer cavity, wherein said second layer resides within said third layer cavity;

wherein said first density is less than 2.0 g/cm$^3$ and said first young's modulus is less than 40 Gpa;

wherein said second density is greater than 2.0 g/cm$^3$ and said second young's modulus is greater than 40 Gpa.

2. A golf club head, comprising:

a body comprising a striking face and a perimeter portion extending aft from said striking face;

wherein said perimeter portion comprises a sole located below said striking face;

wherein said perimeter portion comprises a topline located above said striking face;

wherein said body comprises a body cavity formed behind said striking face and within said perimeter portion;

wherein said striking face comprises a front surface, configured to strike a golf ball, and a rear surface opposite said front surface;

a badge affixed to said rear surface of said striking face;

wherein said badge comprises:

a first layer aft of said striking face, said first layer comprising a first density;

a second layer aft of said first layer, said second layer comprising a second density; and a third layer aft of said first layer;

wherein said third layer comprises a third layer front surface located adjacent said second layer, said third layer font surface comprising a third layer cavity, wherein said second layer resides within said third layer cavity;

wherein said first density is less than 2.0 g/cm$^3$;

wherein said second density is greater than 2.0 g/cm$^3$.

3. The golf club head of claim 2, wherein said first layer comprises a first young's modulus and said second layer comprises a second young's modulus, wherein said first young's modulus is less than 40 Gpa and wherein said second young's modulus is greater than 40 Gpa.

4. The golf club head of claim 2, wherein said second layer comprises a second layer front surface, located adjacent said first layer, a second layer rear surface, located opposite said second layer front surface, a second layer top side surface located towards said topline, and a second layer sole side surface located towards said sole, said second layer sole side surface located opposite said second layer top side surface, wherein said second layer front surface abuts said first layer, wherein said second layer rear surface abuts said third layer, wherein said second layer top side surface abuts said third layer, and wherein said second layer bottom side surface abuts said third layer.

5. The golf club head of claim 2, wherein said first layer is viscoelastic.

6. The golf club head of claim 5, wherein said second layer is aluminum.

7. The golf club head of claim 2, wherein said badge further comprises a fourth layer located aft of said third layer.

8. The golf club head of claim 2, wherein said second layer comprises a plurality of apertures formed through said second layer.

9. The golf club head of claim 2, wherein said striking face comprises a maximum striking face width, wherein said first layer comprises a maximum first layer width, wherein said second layer comprises a maximum second layer width, wherein said maximum striking face width is greater than said maximum first layer width, and wherein said maximum first layer width is greater than said maximum second layer width.

10. The golf club head of claim 9, wherein said third layer comprises a third layer maximum width, wherein said third layer maximum width is greater than said first layer maximum width.

11. A golf club head, comprising:

a body comprising a striking face and a perimeter portion extending aft from said striking face;

wherein said perimeter portion comprises a sole located below said striking face;

wherein said perimeter portion comprises a topline located above said striking face;

wherein said body comprises a body cavity formed behind said striking face and within said perimeter portion;

wherein said striking face comprises a front surface, configured to strike a golf ball, and a rear surface opposite said front surface;

a badge affixed to said rear surface of said striking face;

wherein said badge comprises:

a first layer aft of said striking face, said first layer comprising a first young's modulus;

a second layer aft of said first layer, said second layer comprising a second young's modulus; and a third layer aft of said first layer;

wherein said second layer comprises a second layer front surface, located adjacent said first layer, a second layer rear surface, located opposite said second layer front surface, a second layer top side surface located towards said topline, and a second layer sole side surface located towards said sole, said second layer sole side surface located opposite said second layer top side surface;

wherein said second layer front surface abuts said first layer, wherein said second layer rear surface abuts said third layer, wherein said second layer top side surface abuts said third layer, and wherein said second layer bottom side surface abuts said third layer;

wherein said first young's modulus is less than 40 Gpa;

wherein said second young's modulus is greater than 40 Gpa.

12. The golf club head of claim 11, wherein said first layer comprises a first density and said second layer comprises a second density, wherein said first density is less than 2.0 $g/cm^3$ and wherein said second density is greater than 2.0 $g/cm^3$.

13. The golf club head of claim 11, wherein said third layer comprises a third layer front surface located adjacent said second layer, said third layer font surface comprising a third layer cavity, wherein said second layer resides within said third layer cavity.

14. The golf club head of claim 11, wherein said first layer is viscoelastic.

15. The golf club head of claim 14, wherein said second layer is aluminum.

16. The golf club head of claim 11, wherein said badge further comprises a fourth layer located aft of said third layer.

17. The golf club head of claim 11, wherein said second layer comprises a plurality of apertures formed through said second layer.

18. The golf club head of claim 11, wherein said striking face comprises a maximum striking face width, wherein said first layer comprises a maximum first layer width, wherein said second layer comprises a maximum second layer width, wherein said maximum striking face width is greater than said maximum first layer width, and wherein said maximum first layer width is greater than said maximum second layer width.

19. The golf club head of claim 18, wherein said third layer comprises a third layer maximum width, wherein said third layer maximum width is greater than said first layer maximum width.

20. The golf club head of claim 11, wherein said second layer has a height greater than or equal to 10 mm and a length greater than or equal to 20 mm and wherein said second layer has a plurality of apertures formed therethrough.

* * * * *